US008042561B2

(12) United States Patent
Moravec Varga et al.

(10) Patent No.: US 8,042,561 B2
(45) Date of Patent: Oct. 25, 2011

(54) AUXILIARY CURTAIN

(76) Inventors: Linda Moravec Varga, San Gabriel, CA (US); Alexander L. Varga, San Gabriel, CA (US)

( * ) Notice: Subject to any disclaimer, the term of this patent is extended or adjusted under 35 U.S.C. 154(b) by 216 days.

(21) Appl. No.: 12/122,538

(22) Filed: May 16, 2008

(65) Prior Publication Data

US 2009/0283120 A1 Nov. 19, 2009

(51) Int. Cl.
*A45B 15/00* (2006.01)
*A45B 25/20* (2006.01)
*A45B 25/18* (2006.01)

(52) U.S. Cl. ..... 135/16; 135/33.41; 135/33.2

(58) Field of Classification Search ..... 135/33.7, 135/33.2, 21, 93, 120.1, 15.1, 16, 33.41, 135/117, 902; 160/330, 354, 368.1; 4/558.608
See application file for complete search history.

(56) References Cited

U.S. PATENT DOCUMENTS

| | | | | |
|---|---|---|---|---|
| 734,311 | A | 7/1903 | Ferroussat | |
| 1,774,909 | A * | 9/1930 | Wells | 135/98 |
| 1,854,671 | A | 4/1932 | Roberts | |
| 2,221,366 | A * | 11/1940 | Bisbing et al. | 135/16 |
| 2,453,270 | A | 11/1948 | Russell | |
| 2,502,984 | A * | 4/1950 | Parmenter | 135/33.7 |
| 2,652,845 | A | 9/1953 | O'Neill et al. | |
| 2,863,467 | A | 12/1958 | Hearell | |
| 3,151,621 | A * | 10/1964 | Jackson | 135/16 |
| 3,333,595 | A * | 8/1967 | Bannister et al. | 135/98 |
| 3,382,507 | A | 5/1968 | Micheau | |
| 3,419,024 | A * | 12/1968 | Nickerson, Jr. | 135/98 |
| 3,899,168 | A * | 8/1975 | Besherse | 472/75 |
| 4,086,931 | A * | 5/1978 | Hall | 135/98 |
| 4,449,542 | A * | 5/1984 | McSwain et al. | 135/98 |

(Continued)

FOREIGN PATENT DOCUMENTS

FR 2688463 A1 * 9/1993

(Continued)

OTHER PUBLICATIONS

Varga et al., International Search Report and Written Opinion issued on Aug. 14, 2009 by the Korean Intellectual Property Office for the parent International Patent Application No. PCT/US2009/042069.

*Primary Examiner* — David Dunn
*Assistant Examiner* — Tania Abraham
(74) *Attorney, Agent, or Firm* — The Law Firm of Andrea Hence Evans, LLC

(57) ABSTRACT

A curtain suitable for attachment to the perimeter of an umbrella has a flexible sheet with an upper edge, a lower edge, a first side edge and a second side edge. The flexible sheet also has a front surface and a rear surface, each surface defining an area between about 8 square feet and about 120 square feet. Still further, the flexible sheet has one or more upper edge fastener portions disposed proximate to the upper edge for attaching the upper edge to a foreign surface, and has reversible retaining means for retaining the lower edge at a plurality of locations on the flexible sheet above the lower edge. The reversible retaining means are adapted such that, when the upper edge is attached to an umbrella, the vertical distance between the upper edge and the lowermost portion of the flexible sheet is adjustable by the user without the use of tools.

13 Claims, 2 Drawing Sheets

U.S. PATENT DOCUMENTS 4,706,599 A * 11/1987 Johnson ..... 114/361
4,845,910 A * 7/1989 Hanson et al. ..... 52/287.1
5,495,628 A * 3/1996 Logan ..... 4/558
5,547,010 A * 8/1996 Stuart ..... 160/335
5,601,198 A * 2/1997 Reed ..... 211/183
5,615,461 A * 4/1997 Tominaga et al. ..... 24/452
5,813,160 A * 9/1998 Thoelke ..... 43/1
5,894,642 A * 4/1999 Eberhardt ..... 24/716
5,918,611 A * 7/1999 Amato ..... 135/16
6,024,264 A * 2/2000 Java ..... 224/576
6,942,001 B1 * 9/2005 Crider et al. ..... 160/241
7,195,051 B2 * 3/2007 Nien ..... 160/243
7,559,334 B2 * 7/2009 Cooper ..... 135/90
7,581,555 B2 * 9/2009 McCullough ..... 135/33.2
2004/0020522 A1 2/2004 James
2005/0028851 A1 * 2/2005 Knoepp ..... 135/15.1
2007/0006908 A1 * 1/2007 Arlis ..... 135/98

FOREIGN PATENT DOCUMENTS

GB 2222942 A * 3/1990
GB 2295629 6/1996
JP 11192113 7/1999

* cited by examiner

AUXILIARY CURTAIN

FIELD OF THE INVENTION

This invention relates generally to panels and curtains, especially panels and curtains designed for attachment to an umbrella.

BACKGROUND OF THE INVENTION

Umbrellas have been used to provide localized shade for centuries. A problem with umbrellas stems from their ability to shade the user from the sun's rays only when the sun is generally directly overhead.

One solution for this problem is to provide umbrellas with an auxiliary curtain which attaches on one side of the umbrella and then drapes downwardly to protect the user from the sun's rays when the sun is not directly overhead. Several such curtains have been suggested in the prior art, but all suffer from one or more of the following problems.

One problem is that such curtains are not readily attached to the umbrella. Most such curtains of the prior art require that the umbrella be pre-installed with attachment devices capable of attaching to the curtain.

Another problem with prior art curtains is their general non-adjustability. Each curtain is manufactured with a predetermined length. Users who wish to have a curtain with a little more length or a little less length have no recourse but to purchase a different curtain.

Yet another problem with such curtains is their tendency to unduly flap in the wind.

A still further problem with curtains of the prior art is that they tend to be large and cumbersome and cannot be easily folded up or rolled up for transport and storage.

Accordingly, there is a need for a curtain capable of readily being attached and detached from an umbrella which avoids the aforementioned problems in the prior art.

SUMMARY

The invention satisfies this need. In one aspect of the invention, the invention is a curtain suitable for attachment to the perimeter of an umbrella. The curtain comprises (a) a flexible sheet having an upper edge, a lower edge, a first side edge and a second side edge, the flexible sheet having a front surface and a rear surface, each surface defining an area between about 8 square feet and about 120 square feet; (b) one or more upper edge fastener portions disposed proximate to the upper edge for attaching the upper edge to a foreign surface; and (c) reversible retaining means for retaining the lower edge at a plurality of locations on the flexible sheet above the lower edge, such that, when the upper edge is attached to a foreign surface, the vertical distance between the upper edge and a lowermost portion of the flexible sheet is adjustable by the user of the curtain without the use of tools.

In a second aspect of the invention, the invention is an umbrella/curtain combination. In the combination, the umbrella comprises an upper surface, a lower surface and one or more umbrella surface fastener portions disposed upon either the upper surface or the lower surface of the umbrella. A curtain is attached to either the upper surface or the lower surface of the umbrella. The curtain comprises (i) a flexible sheet having a front surface and a rear surface, each surface defining an area between about 8 square feet and about 120 square feet; (ii) one or more upper edge fastener portions disposed proximate to the upper edge for attaching the upper edge to the one or more umbrella surface fastener portions; and (iii) reversible retaining means for retaining the lower edge at a plurality of locations on the flexible sheet above the lower edge. The upper edge of the curtain is attached to either the upper surface or the lower surface of the umbrella, and the vertical distance between the upper edge and a lowermost portion of the flexible sheet is adjustable by the user without the use of tools.

DRAWINGS

These and other features, aspects and advantages of the present invention will become better understood with reference to the following description, appended claims and accompanying drawings where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figure 1:
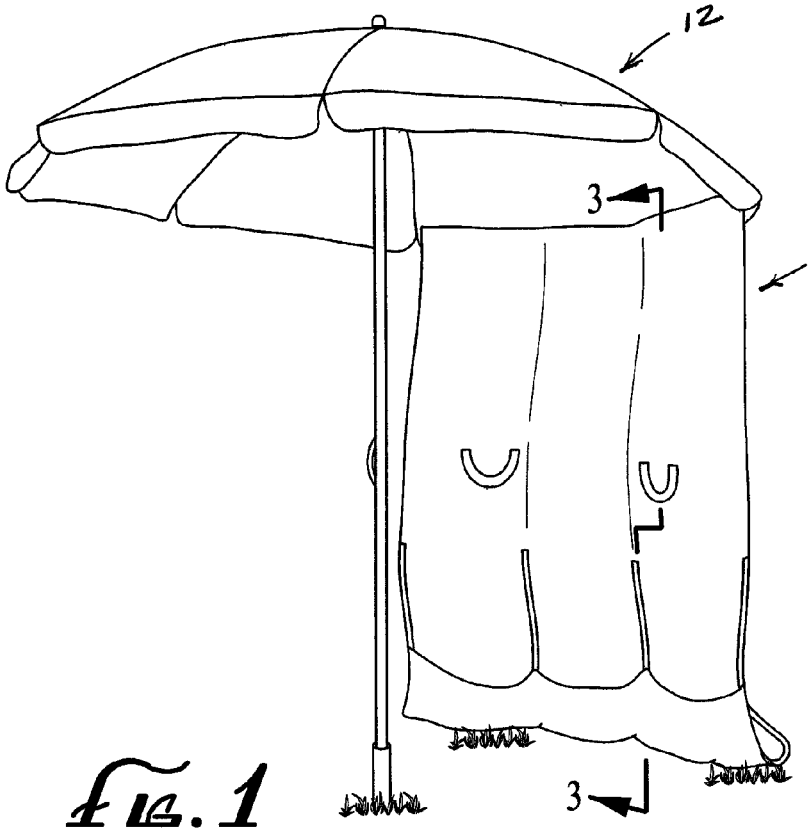
FIG. 1 is a perspective view of an umbrella and curtain combination having features of the invention.
Figure 2:
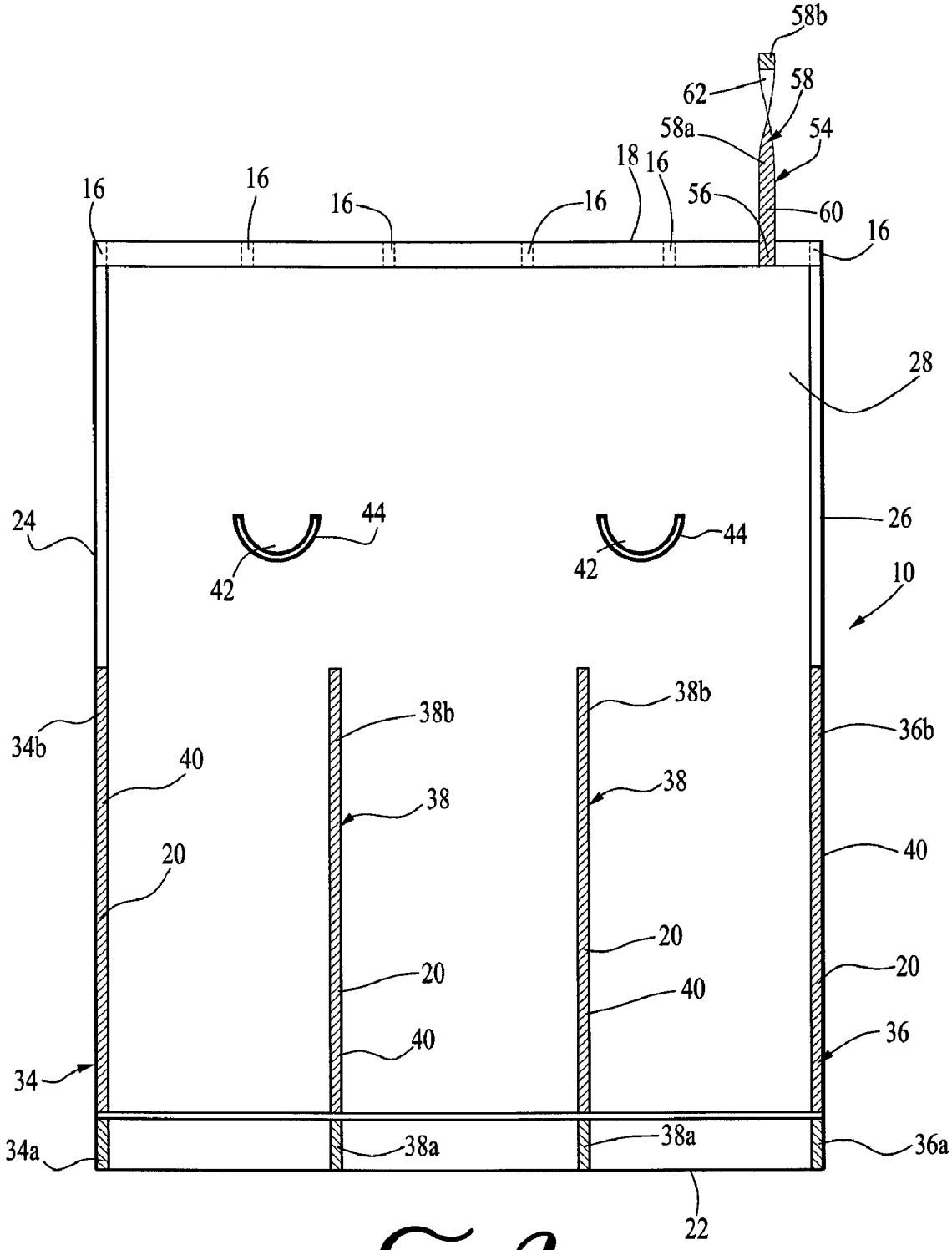
FIG. 2 is a perspective view of a curtain useable in the combination illustrated in FIG. 1.

The invention is a curtain 10 suitable for attachment to the perimeter of an umbrella 12. The curtain 10 comprises (i) a flexible sheet 14, (ii) one or more upper edge fastener portions 16 disposed proximate to an upper edge 18 of the flexible sheet 14 for attaching the upper edge 18 to a foreign surface, and (iii) reversible retaining means 20 for retaining a lower edge 22 of the flexible sheet 14 at a plurality of locations on the flexible sheet 14 above the lower edge 22. FIG. 1 illustrates the curtain 10 in combination with an umbrella 12. FIG. 2 illustrates the curtain 10 by itself.

The flexible sheet 14 has an upper edge 18, a lower edge 22, a first side edge 24 and a second side edge 26. The flexible sheet 14 also has a front surface 28 and a rear surface 30, each surface 28 and 30 defining an area between about 8 square feet and about 120 square feet, more typically between about 15 square feet and about 72 square feet, and most typically between about 24 square feet and about 48 square feet.

In one embodiment, the flexible sheet 14 is generally rectangular and has a width between about 2 feet and about 12 feet and a length of between about 4 feet and about 10 feet. Flexible sheets having a width smaller than 2 feet and/or a length less than 4 feet are generally too small to provide sufficient sun protection for the user. Flexible sheets having a width larger than 12 feet and/or a length larger than 10 feet are generally impracticably large for use in combination with an umbrella. Typically, in this embodiment, the flexible sheet 14 has a width between about 3 feet and about 8 feet and a length of between about 5 feet and about 9 feet. Most typically in this embodiment, the flexible sheet 14 has a width between about 4 feet and about 6 feet and a length of between about 6 feet and about 8 feet.

The flexible sheet 14 can be conveniently made from a multitude of lightweight materials, including, but not limited to, nylon, cotton, vinyl, polyester and polypropylene. Where the flexible sheet 14 is made from such a lightweight material, the material preferably incorporates suitable compounds known in the art for inhibiting damage from ultraviolet sunlight, including, but not limited to, polyamide, polyurethane and polyvinyl chloride.

The one or more upper edge fastener portions 16 are disposed proximate to the upper edge 18 and are adapted for attaching the upper edge 18 to a foreign surface. The one or more upper edge fastener portions 16 can be any of a wide variety of fastener portions known in the art. Preferably, the one or more upper edge fastener portions 16 are hook and loop fastener portions such as hook and loop fastener portions marketed under the Velcro® trademark. Typically, one of the upper edge fastener portions 16 is disposed at a first upper corner on the flexible sheet 14 and a second upper edge 18 portion is disposed at the opposite upper corner of the flexible sheet 14. Also typically, one or more additional of the one or more upper edge fastener portions 16 are disposed in between the two upper corners of the flexible sheet 14.

The reversible retaining means 20 are constructed such that, when the upper edge 18 of the flexible sheet 14 is attached to a foreign surface, the vertical distance between the upper edge 18 and a lowermost portion 32 of the flexible sheet 14 is adjustable by the user of the curtain 10 without the use of tools. The term "without the use of tools" as employed in this application means capable of being accomplished solely with the fingers of the user and not requiring any extrinsic objects, such as screwdrivers, wrenches, etc.

In one embodiment, the reversible retaining means 20 comprises at least one pair of reversible first side edge fastener portions 34 and at least one pair of reversible second side edge fastener portions 36. The at least one pair of reversible first side edge fastener portions 34 comprises a lower first side fastener portion 34*a* disposed proximate to the lower edge 22 and an upper first side fastener portion 34*b* disposed between the lower edge 22 and about 40 inches above the lower edge 22. In the invention, the at least one pair of reversible first side edge fastener portions 34 are capable of alternatively attaching to one another and detaching from one another without the use of tools.

Similarly, the at least one pair of reversible second side edge fastener portions 36 comprises a lower second side edge fastener portion 36*a* disposed proximate to the lower edge 22 and an upper second side fastener portion 36*b* disposed between the lower edge 22 and about 40 inches above the lower edge 22. Like the at least one pair of reversible first side edge fastener portions 34, the at least one pair of reversible second side edge fastener portions 36 are capable of alternatively attaching to one another and detaching from one another without the use of tools.

Typically, the reversible retaining means 20 further comprises at least one pair of reversible central fastener portions 38 comprising a first central fastener portion 38*a* disposed proximate to the lower edge 22 and an upper central fastener portion 38*b* disposed between the lower edge 22 and about 40 inches above the lower edge 22, the at least one pair of reversible central edge fastener portions 38 being capable of alternatively attaching to one another and detaching from one another without the use of tools. In the embodiment illustrated in the drawings, two pairs of reversible central fastener portions 38 are employed.

In one embodiment, the reversible retaining means 20 comprise hook and loop fastener portions such as the hook and loop fasteners marketed under the Velcro® trademark.

In the embodiment illustrated in the drawings, the reversible retaining means 20 further comprises at least one hook and loop fastener portion strip 40 having a length of at least about 12 inches, typically between about 12 inches and about 40 inches. Such a hook and loop fastener portion strip 40 allows for the lower edge 22 of the flexible sheet 14 to be folded upwardly and retained at a multitude of positions above the lowermost portion 32 of the flexible sheet 14.

Figure 4:
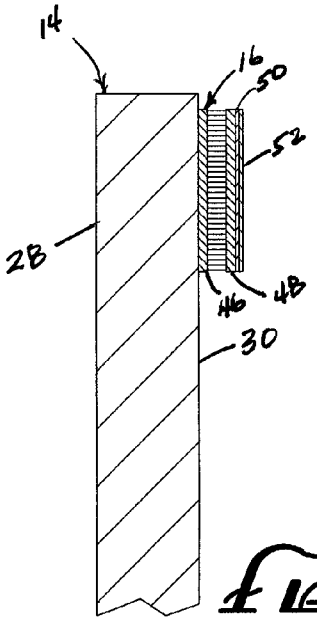
FIG. 4 is a cross-sectional detail view illustrating the upper edge of one embodiment of a flexible sheet useable in the invention.

Preferably, the curtain 10 further comprises one or more vent flaps 42 defined within the flexible sheet 14 to allow the flow of air to pass through the flexible sheet 14, so that the flexible sheet 14 does not flap excessively in the wind. In the embodiment illustrated in the drawings, two such vent flaps 42 are defined, each outlined with peripheral piping 44.

Where the curtain 10 is to be provided as a stand alone product and where the one or more upper edge fastener portions 16 comprise a first hook and loop fastener portion 46, the curtain 10 can further comprise one or more complimentary second hook and loop portions 48 having a layer of contact cement 50 on their reverse sides and with cover layers 52 disposed over the layers of contact cement 50. FIG. 4 illustrates such a complimentary second hook and loop fastener portion 48 attached to the first hook and loop fastener portion 46. Such one or more complimentary second hook and loop fastener portions 48 can be conveniently employed by the user to attach the curtain 10 to an ordinary umbrella 12, one which has not been manufactured with pre-installed umbrella surface fastener portions. Employing this embodiment of the invention, the user can conveniently remove the cover layer 52 of each of the one or more complimentary second hook and loop fastener portions 48 and stick each of the one or more complimentary second hook and loop fastener portions 48 to an umbrella surface, whereupon the one or more complimentary second hook and loop fastener portions 48 become umbrella surface fastener portions. Such an installation is illustrated in FIG. 4.

It is preferable that the curtain 10 comprise a securing strap 54 attached at a first end 56 to either the upper edge 18 of the flexible sheet 14 or to the lower edge 22 of the flexible sheet 14. The securing strap has fasteners disposed on opposite sides of the securing strap 54 has strapped fasteners 58 preferably to allow the securing strap 54 to be attached to itself after it is rolled around the curtain 10. In a typical embodiment, the securing strap 54 is disposed about 6 inches in from a side edge 24 or 26. This allows the curtain 10 to be folded lengthwise to a width of about 12 inches, then rolled up for storage and conveniently secured by the securing strap 54. Also typically, the strap fasteners 58 are hook and loop fastener portions wherein a first strap hook and loop moiety 58*a* is attached to a first side 60 of the securing strap 54 and a second hook and loop moiety 58*b* is attached to an opposed second side 62 of the securing strap 54. The first hook and loop moiety 58*a* on the securing strap 54 is readily attachable and detachable from the second hook and loop moiety 58*b* on the securing strap 54 without the use of tools.

Figure 3:
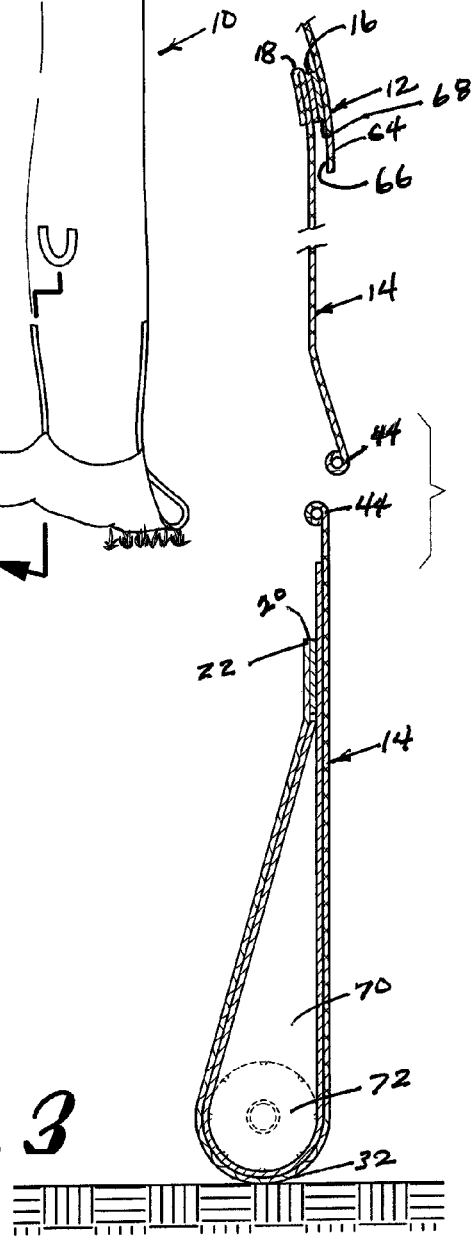
FIG. 3 is a cross-sectional view of the curtain used in the combination illustrated in FIG. 1, taken along line 3-3.

FIGS. 1 and 3 illustrate the curtain 10 in combination with an umbrella 12. The umbrella 12 has an upper surface 64 and a lower surface 66. The umbrella 12 further comprises one or more umbrella surface fastener portions 68 disposed either on the upper surface 64 or the lower surface 66. In the embodiment illustrated in FIG. 1, the umbrella surface fastener portions 68 are disposed on the lower surface 66 of the umbrella 12.

In the embodiment illustrated in the drawings, each one or more umbrella surface fastener portions 68 comprises a hook and loop fastener portion attached to the lower surface of the umbrella 12 by a layer of contact cement 50. In alternative embodiments, the one or more umbrella surface fastener portions 68 can be pre-installed to a surface of the umbrella 12, such as by stitching.

FIGS. 2 and 3 illustrate an important feature of the invention whereby the lower edge 22 of the flexible sheet 14 can be folded proximate to and parallel to the lower edge 22, such that the lower edge 22 is attached to the flexible sheet 14 to form a pocket 70 wherein non-attached ballast 72 can be disposed. Ballast 72 useable in this regard typically has a weight between about 6 ounces and about 10 pounds. Such ballast 72 holds the flexible sheet 14 taut and prevents the curtain 10 from unduly flapping in the wind. The ballast 72 can be provided by a large variety of convenient objects, such as sand, one or more small rocks, a tennis shoe, one or more cans of soda or a bottle of water.

The invention provides a curtain 10 capable of readily being attached and detached from an umbrella 12 and avoids problems with such curtains in the prior art. Specifically, the curtain 10 of the invention does not require attachment to a specially designed umbrella 12 having pre-installed curtain attachment devices. Also, the curtain 10 of the invention is readily lengthwise adjustable. Finally, the curtain 10 of the invention allows the user to conveniently weigh down the lowermost portion of the curtain 10 with ballast which does not have to be pre-installed within the curtain 10, so that, when the curtain 10 hangs down uniformly a predetermined length, it does not unduly flap in the breeze.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A curtain comprising:

a flexible sheet having an upper edge, a lower edge, a first side edge and a second side edge, the flexible sheet having a front surface and a rear surface;

one or more upper edge fastener portions disposed proximate to the upper edge for attaching the upper edge to an external surface; and reversible retaining means for retaining the lower edge at a plurality of locations on the flexible sheet above the lower edge, wherein the reversible retaining means comprise fastener portions extending along the first side edge, the second side edge, and a central portion on the flexible sheet, wherein the fastener portions comprise a lower fastener portion proximate to the lower edge of the sheet and a separate upper fastener portion extending from a top area of the lower fastener portion vertically along the sheet upward to a central area on the sheet;

wherein the lower edge of the sheet is folded upwardly and capable of being retained at a multitude of positions by the reversible retaining means.

2. The curtain of claim 1 wherein the one or more upper edge fastener portions comprise moieties of hook and loop fasteners.

3. The curtain of claim 1 wherein the reversible retaining means comprise hook and loop fastener portions.

4. The curtain of claim 3 wherein the reversible retaining means further comprises at least one hook and loop fastener portion strip.

5. The curtain of claim 1 wherein the one or more upper edge fastener portions comprise a first hook and loop fastener portion, and wherein the curtain further comprises a second hook and loop portion with a layer of an adhesive on its reverse side and with a cover layer disposed over the layer of the adhesive.

6. The curtain of claim 1 further comprising a securing strap attached at a first end to the upper edge of the flexible sheet or to the lower edge of the flexible sheet, the securing strap having a first side with a first hook and loop moiety and an opposed second side with a second hook and loop moiety, the first hook and loop moiety being readily attachable and detachable from the second hook and loop moiety.

7. A combination comprising:

an umbrella having an upper surface, a lower surface and one or more umbrella surface fastener portions disposed upon either the upper surface or the lower surface; and a curtain attached to either the upper surface or the lower surface of the umbrella, the curtain comprising:

a flexible sheet having a lower edge, upper edge, front surface and a rear surface, one or more upper edge fastener portions disposed proximate to the upper edge for attaching the upper edge to the one or more umbrella surface fastener portions on the umbrella;

a vent flap comprising an opening extending through the front and rear surface allowing air to pass through the sheet; and reversible retaining means for retaining the lower edge at a plurality of locations on the flexible sheet above the lower edge, wherein the reversible retaining means comprise fastener portions extending along the first side edge, the second side edge, and a central portion on the flexible sheet, wherein the fastener portions comprise a lower fastener portion proximate to the lower edge of the sheet and a separate upper fastener portion extending from a top area of the lower fastener portion vertically along the sheet upward to a central area on the sheet;

whereby the lower fastener portion is retained along the upper fastener portion at a multitude of positions.

8. The combination of claim 7 wherein the lower edge of the flexible sheet is folded proximate to and parallel to the lower edge, such that the lower edge is attached to the flexible sheet to form a pocket wherein a ballast is disposed within the pocket.

9. The combination of claim 7 wherein the one or more upper edge fastener portions comprise moieties of hook and loop fasteners.

10. The combination of claim 7 wherein the reversible retaining means comprise hook and loop fastener portions.

11. The combination of claim 10 wherein the reversible retaining means further comprises at least one hook and loop fastener portion strip.

12. The combination of claim 7 wherein the umbrella surface fastener portions comprise a hook and loop fastener portion having a first side having hooks or loops and a reverse side having a layer of adhesive.

13. The combination of claim 7 further comprising a securing strap attached at a first end to the upper edge of the flexible sheet or to the lower edge of the flexible sheet, the securing strap having a first side with a first hook and loop moiety and an opposed second side with a second hook and loop moiety, the first hook and loop moiety being readily attachable and detachable from the second hook and loop moiety.

* * * * *